US010431125B2

(12) United States Patent
Ludlow et al.

(10) Patent No.: US 10,431,125 B2
(45) Date of Patent: Oct. 1, 2019

(54) SEPARABLE COMPOSITE LABELING ARTICLES IN SHEET OR ROLL FORM

(71) Applicant: Bedford Industries, Inc., Worthington, MN (US)

(72) Inventors: Robert B. Ludlow, Worthington, MN (US); Justin C. King, Richland, MI (US); Kim A. Milbrandt, Worthington, MN (US); Colin M. O'Donnell, Worthington, MN (US); Jeffrey D. Tschetter, Sioux Falls, SD (US)

(73) Assignee: Bedford Industries, Inc., Worthington, MN (US)

( * ) Notice: Subject to any disclaimer, the term of this patent is extended or adjusted under 35 U.S.C. 154(b) by 4 days.

(21) Appl. No.: 15/891,752

(22) Filed: Feb. 8, 2018

(65) Prior Publication Data

US 2018/0165995 A1 Jun. 14, 2018

Related U.S. Application Data

(63) Continuation of application No. 15/206,373, filed on Jul. 11, 2016, which is a continuation of application No. 14/108,657, filed on Dec. 17, 2013, now abandoned, which is a continuation of application No. 13/667,398, filed on Nov. 2, 2012, now Pat. No. 8,635,795, which is a continuation of application No. 13/108,346, filed on May 16, 2011, now Pat. No. 8,316,566, which is a continuation of application No. 12/160,906, filed as application No. PCT/US2006/001468 on Jan. 17, 2006, now Pat. No. 7,941,953.

(51) Int. Cl.

| | |
|---|---|
| ***G09F 3/02*** | (2006.01) |
| ***G09F 3/04*** | (2006.01) |
| ***G09F 3/14*** | (2006.01) |

(52) U.S. Cl.

CPC ..... *G09F 3/02* (2013.01); *G09F 3/04* (2013.01); *G09F 3/14* (2013.01); *G09F 2003/0227* (2013.01); *Y10T 156/1052* (2015.01); *Y10T 428/15* (2015.01)

(58) Field of Classification Search

None

See application file for complete search history.

(56) References Cited

U.S. PATENT DOCUMENTS 92,895 A * 7/1869 Southworth ..... G09F 3/14 40/27
109,263 A * 11/1870 Southworth ..... G09F 3/14 40/27

(Continued)

*Primary Examiner* — David R Dunn
*Assistant Examiner* — Christopher E Veraa
(74) *Attorney, Agent, or Firm* — Mai-Tram D. Lauer; Westman, Champlin & Koehler, P.A.

(57) ABSTRACT

A linear series of connected unitary sheet-like merchandise labeling articles, each of which comprises a labeling tag flatly cojoined along a unifying flat bond zone with a flexible elastic layer that extends away from the tag and includes an elastic fastening loop. Adjacent labeling articles of the series are ruptureably connected in a manner permitting the series to be handled as a unit while at the same time permitting ruptureable separation of individual merchandise labeling articles from the series. In one embodiment, the linear series is wound into roll form.

10 Claims, 7 Drawing Sheets

(56) References Cited

U.S. PATENT DOCUMENTS 134,116 A * 12/1872 West ..... B43L 1/02 248/118.1
161,145 A * 3/1875 Moder ..... A47K 5/10 222/246
212,578 A * 2/1879 Smith ..... B65D 63/1018 24/17 A
224,958 A * 2/1880 Rowland ..... G09F 3/14 40/665
263,600 A * 8/1882 Searing ..... G09F 3/14 40/27
381,879 A * 4/1888 Howard ..... B65D 63/10 24/17 R
D28,619 S * 5/1898 McFadden ..... D20/22
1,221,572 A * 4/1917 Morton ..... G09F 3/04 40/310
1,397,079 A * 11/1921 Cohen ..... G09F 3/18 40/665
1,830,410 A * 11/1931 Schaaf ..... A22C 17/10 101/128.1
1,929,320 A * 10/1933 Lulham ..... G09F 3/00 40/317
2,194,220 A * 3/1940 Elder ..... B65D 75/54 116/DIG. 14
2,516,292 A * 7/1950 Bennett ..... B65D 63/10 206/497
2,669,047 A * 2/1954 Rieger ..... G09F 3/14 40/637
2,937,464 A * 5/1960 Marshall ..... G09F 3/14 206/806
3,077,683 A * 2/1963 Jones ..... G09F 3/0288 24/DIG. 11
3,164,250 A * 1/1965 Paxton ..... B65B 51/043 206/343
3,545,795 A * 12/1970 Hertel ..... F16B 11/006 403/265
3,602,957 A * 9/1971 Chang ..... B65D 63/109 24/16 PB
3,621,809 A * 11/1971 Paxton ..... G09F 3/12 40/645
3,662,480 A * 5/1972 Gilson, Jr. ..... G09F 3/14 224/182
3,749,622 A * 7/1973 Sato et al. ..... B29C 65/02 156/157
3,777,378 A * 12/1973 Sant'Anselmo ..... G09F 3/14 40/27
3,783,083 A * 1/1974 Jenkins ..... B65C 9/18 156/250
3,896,524 A * 7/1975 Parker ..... B65D 75/02 24/17 B
3,930,506 A * 1/1976 Overend ..... A61B 17/1322 606/203
3,933,560 A * 1/1976 Muttera ..... G09F 3/10 156/227
3,955,656 A * 5/1976 Kashinski ..... A45C 13/008 190/115
4,119,449 A * 10/1978 Gould ..... B29C 65/0627 156/73.5
D251,121 S * 2/1979 Smith ..... D19/10
4,323,608 A * 4/1982 Denny ..... G09F 3/0289 156/DIG. 10
4,341,303 A * 7/1982 Britt ..... B26F 1/18 206/343
4,390,095 A * 6/1983 Cunningham ..... B65D 71/504 206/150
4,407,082 A * 10/1983 Stehouwer ..... G09F 3/14 156/73.1
4,433,498 A * 2/1984 Bienz ..... G09F 3/0358 24/3.6
4,519,178 A * 5/1985 Crabb, Jr. ..... B65B 13/022 100/9
4,529,229 A * 7/1985 Glibbery ..... G09F 3/02 283/75
4,749,426 A * 6/1988 Wyss ..... B29C 37/0082 156/157
5,018,286 A * 5/1991 Zahner ..... G09F 3/0352 24/16 PB
5,026,859 A * 6/1991 Finn ..... A01N 43/50 546/281.7
5,087,306 A * 2/1992 Cheung ..... B29C 65/02 100/3
5,131,614 A * 7/1992 Garcia ..... A47B 21/0371 248/118
5,207,746 A * 5/1993 Jones ..... G09F 3/0289 283/56
D338,195 S * 8/1993 Sugerman ..... D14/461
RE34,366 E * 9/1993 Instance ..... G09F 3/0289 283/103
5,248,164 A * 9/1993 Lepretre ..... B42D 1/10 281/22
5,279,019 A * 1/1994 Knickle ..... A45C 1/06 24/17 B
5,322,724 A * 6/1994 Levens ..... B29C 44/352 428/57
5,334,576 A * 8/1994 Doehner, Jr. ..... A01N 43/50 504/128
5,348,781 A * 9/1994 Koblella ..... B29C 65/0636 156/73.5
5,367,752 A * 11/1994 Petty ..... B65D 63/109 24/17 B
5,378,843 A * 1/1995 Strong ..... C07D 213/80 544/215
5,388,739 A * 2/1995 Gargan ..... A45C 11/18 224/604
5,467,897 A * 11/1995 Williams ..... B65D 35/18 206/805
5,531,696 A * 7/1996 Menes ..... A61B 17/3401 206/805
5,617,656 A * 4/1997 Ludlow ..... G09F 3/14 40/665
D385,581 S * 10/1997 Linz ..... D20/42
D386,211 S * 11/1997 Taparauskas, Jr. ..... D20/22
5,683,194 A * 11/1997 Emmel ..... B42F 3/00 281/38
5,697,177 A * 12/1997 Ludlow ..... G09F 3/14 40/663
5,700,537 A * 12/1997 Instance ..... G09F 3/0289 156/253
5,713,467 A * 2/1998 Kao ..... B65D 73/0014 206/349
5,733,652 A * 3/1998 Stowman ..... B65D 63/1009 156/60
5,760,239 A * 6/1998 Wu ..... C07D 213/803 546/286
5,778,583 A * 7/1998 Larsen ..... G09F 3/14 40/637
5,866,219 A * 2/1999 McClure ..... B32B 3/06 428/40.1
6,024,225 A * 2/2000 Van der Donk ..... B26F 1/3866 100/9
6,058,639 A * 5/2000 Tinklenberg ..... G09F 3/04 40/637
6,076,669 A * 6/2000 Ling ..... B65D 73/0064 206/349
6,116,653 A * 9/2000 Oberholzer ..... B24D 15/00 283/101
6,146,731 A * 11/2000 Tanoto ..... B32B 7/04 428/43
6,270,834 B1 * 8/2001 Burrows ..... H05B 33/00 156/182
6,271,631 B1 * 8/2001 Burrows ..... G09F 13/22 313/511
6,355,403 B1 * 3/2002 Bourdelais ..... G03C 1/46 430/394
6,378,700 B1 * 4/2002 Tong ..... B65D 73/0064 206/349
6,381,890 B1 * 5/2002 Sjostedt ..... G09F 3/08 248/206.5

(56) References Cited

U.S. PATENT DOCUMENTS

| | | | | |
|---|---|---|---|---|
| 6,413,122 | B2 * | 7/2002 | Fujioka | H01R 13/6453 361/796 |
| 6,449,886 | B1 * | 9/2002 | Gray | G09F 1/10 281/21.1 |
| D494,066 | S * | 8/2004 | Liu | D9/415 |
| D501,892 | S * | 2/2005 | Perry | D20/10 |
| 6,991,261 | B2 * | 1/2006 | Dronzek, Jr. | B32B 27/32 283/81 |
| D532,049 | S * | 11/2006 | Ludlow | D20/22 |
| 7,836,622 | B1 * | 11/2010 | King | G09F 3/14 206/820 |
| 7,941,953 | B2 * | 5/2011 | Ludlow | G09F 3/04 40/665 |
| 2003/0096076 | A1 * | 5/2003 | Allison | C09J 7/20 428/43 |
| 2003/0150919 | A1 * | 8/2003 | Blank | G06Q 20/342 235/487 |
| 2005/0138854 | A1 * | 6/2005 | Simmons | G09F 3/14 40/665 |
| 2005/0166439 | A1 * | 8/2005 | Ludlow | G09F 3/14 40/665 |
| 2005/0173073 | A1 * | 8/2005 | Chernoff | G09F 3/14 156/556 |
| 2005/0255277 | A1 * | 11/2005 | Syron | B05B 12/24 428/43 |
| 2006/0086028 | A1 * | 4/2006 | Vaughan | G09F 3/14 40/665 |
| 2006/0147668 | A1 * | 7/2006 | Hirose | G09F 3/02 428/42.3 |
| 2006/0272185 | A1 * | 12/2006 | Malama | B42D 1/10 40/124.01 |
| 2007/0020423 | A1 * | 1/2007 | Chamandy | G09F 3/10 428/40.1 |

* cited by examiner

SEPARABLE COMPOSITE LABELING ARTICLES IN SHEET OR ROLL FORM

CROSS-REFERENCE TO RELATED APPLICATION(S)

This application is a continuation of U.S. patent application Ser. No. 15/206,373, filed on Jul. 11, 2016; which is a continuation of U.S. patent application Ser. No. 14/108,657, filed on Dec. 17, 2013 (now abandoned); which is a continuation of U.S. patent application Ser. No. 13/667,398, filed on Nov. 2, 2012 and issued as U.S. Pat. No. 8,635,795; which is a continuation of U.S. patent application Ser. No. 13/108,346, filed on May 16, 2011, and issued as U.S. Pat. No. 8,316,566, which is a continuation of U.S. patent application Ser. No. 12/160,906, filed on Jul. 15, 2008, and issued as U.S. Pat. No. 7,941,953; and which claims priority to and is a 371 National Stage Application of International Application No. PCT/US2006/001468, filed on Jan. 17, 2006, and which published as International Publication No. WO 2007/084119.

FIELD

This invention relates to a linear series of connected unitary sheet-like merchandise labeling articles of the type having a tag bonded to an elastic fastening loop, wherein adjacent labeling articles of the series are ruptureably connected to permit discrete separation of an individual labeling article from the series.

BACKGROUND

Discrete merchandise labels are known which comprise a unitary sheet-like labeling article which has a labeling tag flatly cojoined along a unifying flat bond zone with a flexible elastic layer that extends away from the tag and includes an elastic fastening loop. The elastic fastening loop can function much like a rubber band in holding together a group of merchandise (e.g., produce or cut flowers) or in allowing application of a labeling article to a single piece of merchandise or container therefor (e.g., a jar or bottle) and thus effectively provide product labeling or additional product labeling information. The tag may likewise include a UPC bar code thereon for product identification and optical scanning. Such a unique form of a merchandise labeling article is disclosed in U.S. Patent Application Publication No. 2005/0166439 A1.

While the formation of such a merchandise labeling article has resulted in a novel and efficient labeling product, as well as a useful means for banding merchandise together, an organized form of storage, transport and dispensing for such merchandise articles is desirable. Heretofore, such articles were available only as discrete, individual labeling articles.

SUMMARY

A roll of a series of labeling articles, the roll comprising a tag strip of ruptureably-connected tag portions of the labeling articles; and a loop strip of elastic fastening loops of the labeling articles secured to the tag strip at a bond zone; wherein the series of labeling articles are wound in an overlapping tight condition at the bond zone, and wherein the tag portions are wound in an overlapping loose condition relative to the overlapping tight condition of the bond zone, such that the tag portions are partially collapsible radially under pressure.

A roll of a series of labeling articles, the roll comprising a tag strip of ruptureably-connected tag portions of the labeling articles, wherein the tag portions are wound in an overlapping condition to provide collapsible spaces therebetween; and a loop strip of elastic fastening loops of the labeling articles secured to the tag strip at a bond zone, wherein the series of labeling articles are wound in an overlapping tight condition at the bond zone.

A method for manufacturing a roll of labeling articles, the method comprising providing a series of the labeling articles having a tag strip of ruptureably-connected tag portions of the labeling articles, and a loop strip of elastic fastening loops of the labeling articles secured to the tag strip at a bond zone; and winding the series of the labeling articles around a rigid core, which comprises winding the bond zone in an overlapping tight condition around the rigid core; winding the elastic fastening loops in an overlapping condition, wherein the winding of the elastic fastening loops is performed with the winding of the bond zone; and winding the tag portions in an overlapping loose condition relative to the overlapping tight condition of the bond zone, such that the tag portions are partially collapsible radially under pressure, wherein the winding of the tag portions is performed with the winding of the bond zone.

This summary is not intended to describe each disclosed embodiment or every implementation of the present invention. Many other novel advantages, features, and relationships will become apparent as this description proceeds. The figures and the description that follows more particularly exemplify illustrative embodiments.

BRIEF DESCRIPTION OF THE DRAWINGS

The present invention will be further explained with reference to the attached figures, wherein like structure or features are referred to by like reference numerals throughout the several views.

While the above-identified figures set forth several embodiments of the present invention, other embodiments are also contemplated, as noted in the disclosure. In all cases, this disclosure presents the invention by way of representation and not limitation. It should be understood that numerous other modifications and embodiments can be devised by those skilled in the art which fall within the scope and spirit of the principles of this invention.

DETAILED DESCRIPTION

Figure 1:
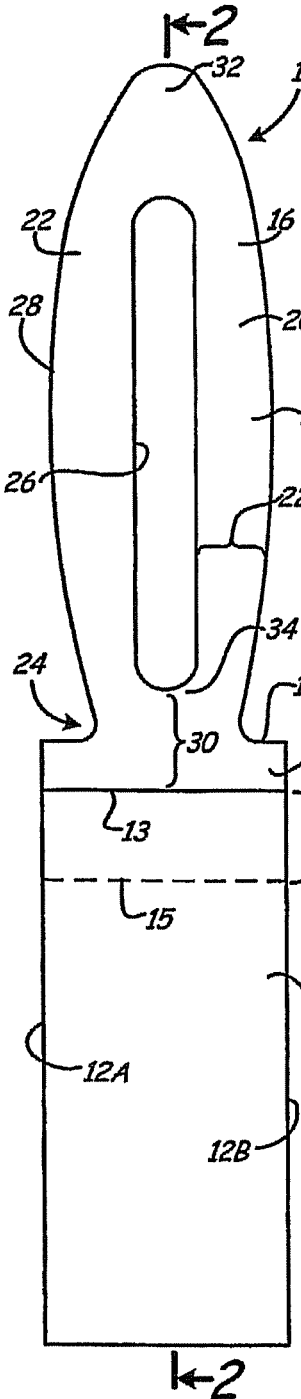
FIG. 1 is a schematic frontal (face) view of an illustrative merchandise labeling article of this invention.
Figure 2:
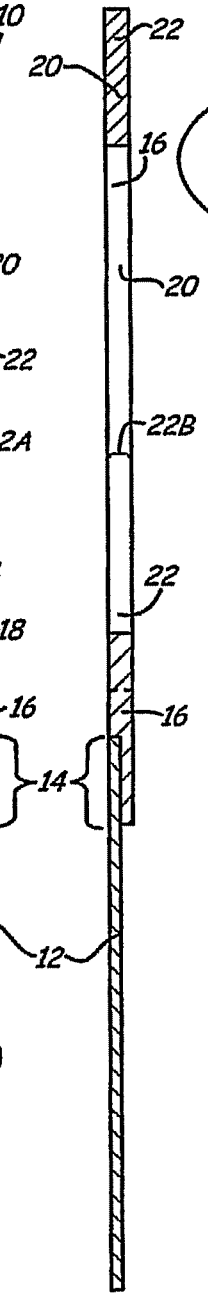
FIG. 2 is a schematic cross-sectional view taken on line 2-2 of FIG. 1.
Figure 5:
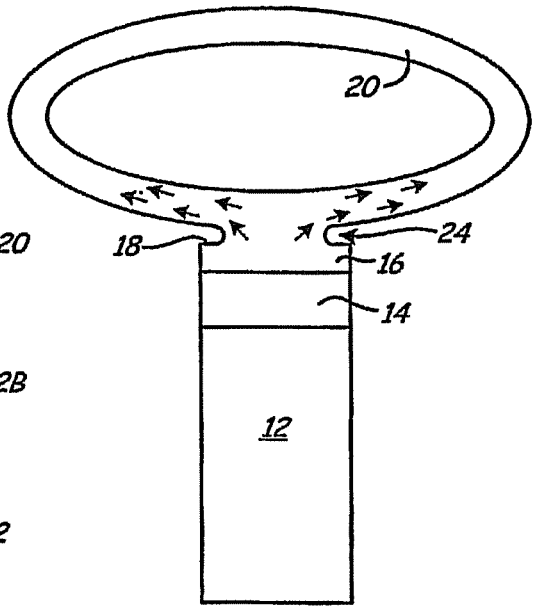
FIG. 5 is a schematic frontal view of a merchandise labeling article of the invention with the elastic loop stretched laterally and with arrows illustrating the direction of stretch in the neck area of the new article and particularly illustrating how the stretching in the neck area reduces the transmission of in-line stretching forces into the bond zone that conjoins the elastic layer with the tag itself.
Figure 3:
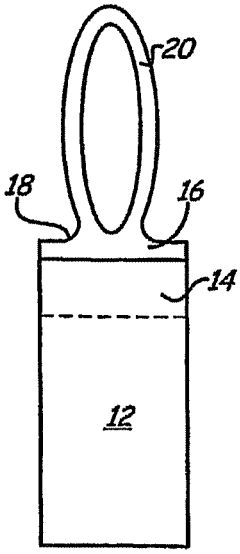
FIGS. 3 and 4 are schematic frontal views of other illustrative merchandise labeling articles of the invention.
Figure 4:
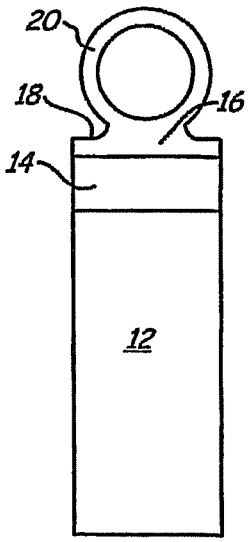
Figure 6:
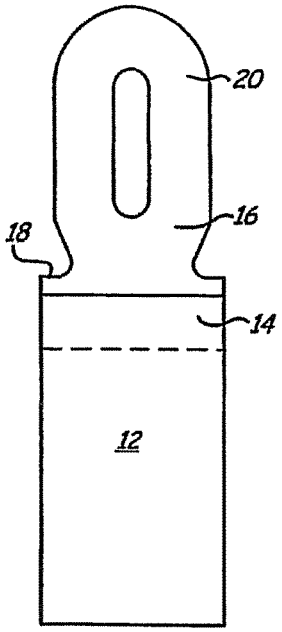
FIGS. 6, 7, and 8 are schematic frontal views of illustrative new articles having varied elastic fastening loops.
Figure 7:
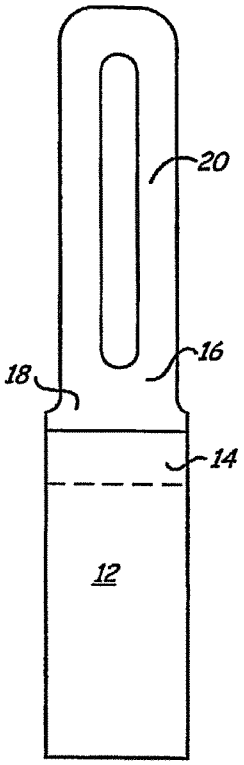

It first should be noted that FIGS. 1 and 2 may be looked upon as somewhat enlarged views of a new article 10 of the invention. Their size permits easier illustration of the different parts of the new article. Of course, new articles as large or larger than the size of FIGS. 1 and 2 are within the scope of this invention. However, FIGS. 3, 4, and 5 are more representative of the actual size for many new articles of the invention that are expected to be the most popular—it being recognized that economy of material usage contributes to economy of resulting price for purchasers. In rare instances, however, the question of price can take second place to the importance of large and dominating articles of the invention.

Referring to FIGS. 1 and 2, the new article has a labeling tag 12 flatly conjoined along a unifying flat bond zone 14 with a flexible elastic layer 16 that extends away from the tag 12 and contains an elastic fastening loop 20 that has flat loop sides 22 that define the fastening loop and are wider (as illustrated at 22A in the view of FIG. 1) than they are thick (as illustrated at 22B in the view of FIG. 2). The entire article is sheet-like in the sense that tags are sheets of a flat nature and layers (as of elastic) are also sheets of flat character although they may be drapeable and floppy and thus not always displayed in flat form. The key point is that the sheet of tag material and sheet of elastic layer material are flatly conjoined, which means that the tag and elastic layer are not joined in a perpendicular relationship to each other. Instead, they are joined so that the sheet character of each extends into the sheet character of the other, giving a total unitary sheet-like character to the entire product. Further, the result is a unifying flat bond zone at the conjoining of the tag and elastic layer. Details for that bond zone are discussed below.

The width of the tag 12 between its sides 12A and 12B in the bond zone 14 and the width of the elastic layer 16 in the bond zone are preferably about equal.

The flexible elastic fastening loop 20 has an internal edge circumference 26 that defines the boundary of the hole through the loop as well as the inside edge circumference of the loop. The outer edge or boundary of the loop can be looked upon as its outer circumference 28. Both boundaries for the sides of the loop lie in the flat plane of the elastic layer 16, and thus the sides 22 of the loop (being part of the elastic layer) are also properly looked upon as flat. To summarize, the elastic fastening loop has flat loop sides 22; and those sides define the loop and its inner or internal edge circumference 26 and its outer or external edge circumference 28. The outer circumference includes a section that merges into the bond zone 14.

The distal end 32 of the loop is the end furthest from the bond zone 14, and the proximal end 34 of the loop is closest to the bond zone. The proximal end of the inner circumference 26 may itself optionally (but not preferably) merge into the bond zone. Ideally, the proximal end 34 of the inner circumference 26 is spaced from the nearest edge 13 of the bond zone 14. The farthest edge 15 of the bond zone 14 is most remote from the loop. The edges 13 and 15 of the bond zone 14 should be looked upon as schematically illustrated in the drawing simply because the unification between an overlapped edge of the tag 12 and an overlapped edge of the elastic layer 16 can take a variety of forms, including those that may make the nearest edge 13 of the bond zone as well as the farthest edge 15 of the bond zone somewhat irregular or even greatly irregular.

Nevertheless, the distance between the proximal portion of the inner circumference 26 and the nearest edge 13 of the bond zone is most preferably sufficient to provide a zone 30 which can be called a dispersion zone. Its function is to disperse at least some of the in-line tension forces created as a result of the stretching of an elastic loop about merchandise. Those tension forces are called "in-line" tension forces because they are in the line of stretching of the loop. Dissipation of such tension forces is desirable at least to some extent so as to reduce (or sometimes even substantially eliminate) the stress of that tension passing into the bond zone 14.

The interesting thing about the new labeling article of the invention is the fact that substantial dispersion or even dissipation of those in-line tension (i.e., stretching) forces can take place in the dispersion zone so as to quite significantly temper or reduce the stress those forces put on the bond zone 14. FIG. 5 illustrates the tension forces that arise within the elastic loop on stretching it about merchandise. Significantly, the lateral shoulders 18 created by forming a neck indentation 24 at the proximal end of the elastic layer containing the elastic loop 20 tend to assist in relieving or dissipating tensioning forces within a stretched loop from being transmitted into the bond zone 14 at its lateral edges. Thus, a relatively weaker unification between the tag and the elastic layer at the bond zone is permissible for the new article of the invention as compared to the strength of unification in a bond zone needed between a strip of elastic material and any other material that forms a band about merchandise where the bond zone between parts of the band is continually subjected to the tension of a band stretched about merchandise.

Ideally, the dispersion zone 30 should be at least as deep (i.e., "wide" in the direction away from the bond zone) as about half the narrowest width (see 22A) of the loop sides, and preferably should be somewhat larger, such as at least about equal to the narrowest width of the loop sides. Effective dispersion function generally requires some minimal distance between the proximal end of the inner circumference 26 and the nearest edge of the unifying bond zone 14. The minimum distance should be at least about 50 mils (preferably more) even for the narrowest of practical widths for elastic loops in the practice of the invention. More appropriately, the minimal distance between the proximal end of the inner circumference 26 and the bond zone 14 should be about ⅛ inch or 125 mils—and preferably that distance will be greater than ⅛ inch or 125 mils—for what is perceived to become the most popular of the new labeling articles of the invention. The greater the distance of the dispersion zone 30, the more likely lateral tensioning forces in a stretched loop (as illustrated in FIG. 5) will be tempered or even completely dissipated (or substantially so), and not significantly transmitted into the bond zone 14; but practical economy requires the lowest volume of usage of material effective to accomplish the function desired. Thus, dispersion zones 30 in excess of about ½ inch or 500 mils in depth (as well as loop sides wider than about ½ inch or 500 mils) will be relatively rare and likely realistic only for labeling articles of the invention where expense is of no great concern. Nevertheless, dispersion zones of a depth of ¾ inch (750 mils) or even a full inch can sometimes be useful to reduce the passage of the tension of stretching into the bond zone. Similarly, loop sides of similar greater width (e.g., ¾ inch and even a full inch) can sometimes be useful (e.g., where larger articles of the invention are needed). Generally, and especially for banding agricultural produce, economy for the new product is a critical consideration and will dictate dispersion zones and loop sides no greater than necessary to maintain integrity for the product in the use expected of it.

It is appropriate to emphasize that the proximal end of the inner circumference 26 of the loop 20 is preferably distanced from the bond zone 14 by the dispersion zone; and when shoulder 18 is present, the proximal end of the inner circumference 26 should be more distant from the bond zone 14 than the optional shoulder 18 that contributes to forming the lateral indentations that in turn form the neck 24 of constricted width for the elastic layer 16.

Figure 8:
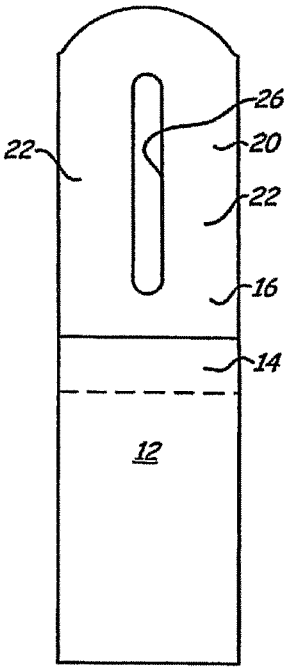

Features in FIGS. 3, 4, 5, 6, 7, and 8 are numbered using the same numbering as in FIGS. 1 and 2. Thus, in these figures, the ideal flat labeling tag 12 is flatly conjoined along a unifying flat bond zone 14 with an elastic layer 16 containing an elastic fastening loop 20 that extends away from the tag and has flat loop sides that define the fastening loop and are wider than they are thick—all as discussed in connection with FIGS. 1 and 2. The significant thing about FIG. 3 is that its profile as shown has substantially the same dimensions (other than the longitudinal length of the tag) for its different parts as in several practical convenience articles of the invention used for marking agricultural produce as well as other products. The ideal FIG. 3 style of product has a tag about 1 inch wide and anywhere from about 1 inch to about 5 inches long, plus an elastic layer not wider than about 1 inch (i.e., not wider than the width of the tag) and anywhere from about 1 inch to about 4 or 5 inches (preferably about 1¾ or 2 or 3 inches) in length from the bond zone 14. It has a transverse bond zone formed at the overlap of the conjoined edges of the tag and elastic layer. That overlap is generally about 3/16 or ¼ inch or even ⅜ inch but usually not over about ½ inch or more. FIG. 4 also is an illustration where the dimensions of the showing are essentially identical to practical products of the invention, but to be especially noted is that the elastic loop of FIG. 4 is circular as distinct from oval, which sometimes may be a preference of shape for specialized labeling applications (especially for bottles). To be noted is that FIGS. 3, 4, 5, 6, and 7 illustrate a shoulder 18. FIG. 8 does not. The width of the loop sides 22 in FIG. 8 is greater than in any other frontal view illustrated and is accompanied by a very narrow central opening defined by the internal circumference 26 for that opening.

Referring to FIG. 5, the oval elastic loop there illustrated is in a laterally stretched orientation that puts its stretched longest dimension in a lateral or transverse direction (e.g., parallel with bond zone 14). If that loop were looked upon as non-stretched, the loop's longest dimension would be greater than the width of the tag. Elastic layers that have their longest non-stretched dimension extending transverse to the depending tag are within the ambit of the invention, but are not preferred. The most preferred articles of the invention will usually have their elastic loop so oriented that the outer circumference 28 will never reach a lateral or transverse extent beyond the widest lateral extent for the sides of the labeling tag 12. This preference applies to the widest lateral width between the sides 12A and 12B of the tag 12. Rectangular style tags are by far the more practical for economy purposes, 11 but tags themselves may indeed take different forms such as octagonal shapes, triangular shapes, rhomboidal shapes, circular shapes, oval shapes, and even irregular shapes. The maximum distance between the sides 12A and 12B is ideally always greater than the maximum lateral (transverse) distance for the outer boundary or circumference 28 of the elastic loop. Further, when labeling tags other than generally rectangular ones or square ones are used, the bond zone 14 may vary in lateral extent, and features such as the shoulders 18 and the neck indentation 24 may be modified or even omitted; but a dispersion zone 30 preferably will always be maintained so as to temper the transmission of tension forces into the bond zone 14 when the elastic loop is stretched about merchandise.

The thickness of tags for practicing the invention should be great enough to give some body effect but ideally will not be greater than necessary for carrying appropriate information to describe a product or whatever item the tag is designed to identify. The tag should be in the form of a continuous panel of sheet material, although tags with holes in them are within the ambit of the invention. Suitable sheet material for tags is preferably relatively thin, generally not over about 15 or 20 mils (i.e., 0.015 or 0.020 inch) in thickness (although thicknesses up to 30 or 40 mils can be used where cost is no object). The tag material should be flexible and pliable but is most preferably not elastic for most applications. Of course, UPC codes on elastic materials can sometimes perform satisfactorily for scanning purposes, but uncertainty as to reliability for that performance has to be considered. (A stretchy but non-elastic material such as the polyolefin thermoplastic printable microporous product called "Teslin" from PPG Industries of Pittsburgh, Pa. can sometimes be used as tag material for the new article of the invention where pulling distortion of the tag is expected to be only nominal, or zero. Use of "Teslin" is not preferred because it can be stretched by hand pulling and is extremely slow in any tendency to return to its original shape. It lacks the bounce-back feature of elastic material.) For the most part, the tag material preferably should be sufficiently non-stretchy under hand-applied forces that a UPC scannable code is not rendered unreliable for scanning. Thus, the sheet material should have the dimensional stability to carry a reliably scannable (i.e., non-distorted) print of a UPC code as well as other easily read markings.

The sheet material for the tag also preferably should be sufficiently water resistant to not disintegrate and not significantly pucker or wrinkle or otherwise disfigure or deform when placed in water. In fact, not only the sheet material but also the printing on it, and especially any scannable product identification matter on it, should ideally be sufficiently water resistant to avoid disintegration or destruction when repeatedly subjected to water and washing operations (as is common for produce displays in supermarkets). The sheet material for the tag also should be somewhat tough in the sense of being sufficiently tear resistant to deter damage to it from customer handling.

Useful materials for forming the tag sheet material include paper (which is not preferred), polystyrenic thermoplastics (which are among those preferred especially when composed or treated for good printing ink reception) as well as polyolefinic thermoplastics, polyesters, and others that exhibit the properties discussed (which can vary depending on how the new article of the invention is to be used in the marketplace). Thermoplastic materials are best to use, and polymers of styrene, ethylene, propylene, as well as a variety of other monomers and mixtures of monomers (e.g., to make co-polymers and ter-polymers, etc.) can be used. Sheet thickness for polyester plastics and some others can be quite thin, even down to the 3 or 4 mil range, and still exhibit the toughness and the practical non-elasticity desired. The polymers may be formulated so that printing inks are readily accepted on the surface of the sheet material or treated with special surface treatments to effect acceptance of printing inks. The exact structure and composition of suitable tag sheet material for practicing the invention can vary widely.

Any of a variety of commercially available inks compatible or accepted on a tag sheet and retained thereon, and in any desired color, may be used to print the markings and details of the information portion of the tag. Such technology is readily understood in the art. (If it should be desired to use water-soluble ink markings, a thin film of water-insoluble plastic may be applied over them to enhance water resistance.) High-impact polystyrene sheets are especially useful as tag material. To improve impact properties toward the high end, a styrene-butadiene-styrene impact modifier can be useful in amounts up to about 40 percent of the weight of the polystyrene itself. Tags of such material are highly stable against stretching of the type that will damage scannability for bar codes. They have desired flexibility balanced by a slight stiffness that contributes to ease of handing during manufacture of the new product and also to ease of handling during use of the new product, including scanning of a UPC code at check-out counters. Such tags also can be reliably printed, especially when first subjected to a surface treatment such as, for example, a corona treatment such as available from Pillar Technologies of Hartland, Wis., a division of Illinois Tool Works. The treatment is said to enhance wettability and adhesion characteristics of plastic substrates to inks and adhesives. It cannot be overemphasized that, where reliably scannable UPC markings are critical, the tag portion of the new sheet-like product should be substantially non-elastic, that is, sufficiently non-elastic to avoid the risk of unscannable distortion for the code.

The size of the front and rear surfaces of the tag 12 for the new article can vary depending on the purpose for which the new article is being formed. For the most part, tags 12 having front and rear areas (rectangular, square, oval, etc.) of at least about 1 square inch are preferred, although even smaller tag areas may be used when minimal printing on the tag is to be employed. Generally, the size of tags is no greater than that necessary to carry the informational matter to be printed on the tag, such as a scannable UPC code, PLU numbers, any product description, illustration, or the like, as well as any special trademarks or source markings, addresses, and phone numbers, etc. The more popular tags are apt to have a size of at least about ½ or 2 square inches up to about 3 or 4 square inches, although larger sizes can, of course, be used. Sizes above about 6 or 7 square inches, however, are likely to be rare. Nevertheless, tags as large as 10 square inches or even 15 or 20 square inches are contemplated as within the scope of the invention.

The elastic portion of the new product will generally have a layer thickness that is greater than the thickness of the tag portion by at least about 20 percent up to about four or even five or six times the thickness of the tag portion (as for example where tags having a thickness of only about 6 or 8 mils are employed). Preferably the thickness of the elastic layer that extends away from the tag will have a thickness greater than about twice the thickness of the tag, but usually will not exceed about 30 or 35 mils when the tag thickness lies in what is expected to be the popular range of about 5 to about 10 mils. It is conceivable, of course, to form the new product with a tag thickness and elastic layer thickness approximately equal (especially where one employs fusion bonding for the bond zone between the tagging material and the elastic material). It is also conceivable to use elastic layer thicknesses up to but not usually greater than 100 mils. (In articles where the bond zone reveals the thickness of the tag as well as the elastic layer, the elastic layer generally should be at least as thick as the tag or even at least twice the thickness of the tag in that bond zone.) Because strong need exists to make useful product in the most economical manner, the amount of material (for thickness and size) used in making the product should be kept to a minimum for satisfactory functional results. Thus, tag thicknesses generally will fall below 10 mils; and the elastic layer, while usually thicker, will generally fall in the range of 15 to 30 mils in thickness.

In all instances, the loop is part of the elastic layer (even though composition may vary) and generally will be of the same thickness as the part of the elastic layer extending out from the bond zone part of the tag. The width (e.g., see 22A) of the sides defining the fastening loop of elastic material will be greater than, and generally at least two or three or five times (and even 10 or 20 times) greater than, the thickness of those sides.

The sides of the loop should have sufficient elastic strength to permit stretching of the loop to an inner circumferential size at least three times greater than the relaxed unstretched inner circumferential size of the loop, and this stretching should be accomplished without fracture for practical products of the invention. The relaxed unstretched inner circumference 26 will vary depending on the size of the opening desired for the loop. The relaxed unstretched inner circumference may range from as little as about 1.5 inches (rarely smaller) up to possibly 5 inches (rarely larger). But the relaxed unstretched inner circumference within the scope of the invention is not limited to the more popular range. Thus, the lower limit of size for the relaxed unstretched inner circumference may be as low as about 0.5 inch or less for some useful products (as for flower work), and the upper limit of size for the relaxed unstretched inner circumference for other useful products may be as great as 10 or 20 or more inches. Generally, the relaxed unstretched inner circumference 26 will not exceed about 6 or 8 or possibly 10 inches for most products, except, of course, for the marking of large-diameter products such as melons. (One must keep in mind that the term "circumferential" is equally apt to describe an edge of an oval or elliptical or a varied similar shape as well as a purely circular or approximately circular shape.)

Ideally, the width 22A of the flat loop sides that define the fastening loop will, at all portions of those sides, be at least 1/10 of an inch or 100 mils (although narrower widths can have specialized uses). The most ideal widths are those that are adequate to insure some degree of strength for the loop as it is placed about merchandise (especially clumped merchandise such as onions or asparagus, etc.) for the purpose of holding the merchandise together. The best widths for flat loop sides thus preferably fall within the range of at least 100 mils (generally at least about ⅛ inch or 125 mils) up to about ½ inch or about 500 mils for elastic layer thicknesses, especially those between about 0.012 inch or 12 mils and 0.030 inch or 30 mils—with the width relatively greater for the thinner thicknesses and relatively less for the greater thicknesses being possible—all to insure adequate loop strength for stretching and retraction about merchandise without causing overuse of material to make the product.

Materials for forming the elastic layer including the elastic loop of it are rubber-like in character. In short, they should bounce back from a stretched condition relatively quickly, but absolutely instantaneous retraction or bounce back to an original relaxed condition after stretching is not always critical for functional elastic performance. Substantially instantaneous retraction to a loop inner circumferential condition no greater than 5 percent above the original unstretched loop inner circumference condition can suffice for a multitude of uses. A substantially instantaneous loop retraction is accomplished when, after relaxation from having been momentarily stretched to a predetermined extent, it takes no more than 3 seconds for the loop to retract (bounce back) to an inner circumference size no more than 5 percent greater than the inner circumference of the original unstretched loop. A momentarily stretched condition is one where the stretch is not held for more than 2 or 3 seconds and the predetermined extent of the stretch is three times (or more) the inner circumference of the loop in unstretched relaxed condition. There may be occasions where retraction may take more than 2 or 3 seconds (up to possibly 5 or 10 seconds) and still may constitute sufficiently speedy retraction to be useful as elastic material in practicing the invention. Those skilled in the art of elastic performance features are well aware that they should select elastomers for the elastic stretch and retraction characteristics required for a particular job they want performed.

In selecting elastomers for the elastic layer, substantially instantaneous retraction is most preferred for rapid clumping of products (because slower retraction may well cause some product to fall out of the clump before retraction takes place). On the other hand, a modestly slower retraction may be quite adequate where new labeling article of the invention is to be stretched about a single product under conditions where speed of retraction (bounce back) is reliable but not the dominant consideration. Of course, the most ideal products of the invention will exhibit almost instantaneous retraction from momentary stretching.

A variety of elastomers giving satisfactory elasticity and stretchability can be useful in practicing the invention. The ideal elastomers are those that are thermoplastic in that they are at least heat softenable and even heat meltable to a flowable or moldable state. A multitude of thermoplastic elastomers are known and more are being created every day. One of the more common families of thermoplastic elastomers is the styrenic block co-polymers. This family includes styrene-butadiene styrene and styrene-ethylene-butylene styrene. Another family of useful thermoplastic elastomers is the olefinic elastomers including those that are ethylene as well as those that are polypropylene based (e.g., where interposed different monomer blocks are not used but blocks of different tacticity—atactic and isotactic—are created by using metallocene catalysis polymerization). Yet another family of thermoplastic elastomers are known as polyvinyl chloride-based elastomers. Still other families of thermoplastic elastomers can be based on urethanes, nylon, silicon, etc. Selection of elastomer is generally made on the basis of cost, and with due attention to bonding characteristics for the tag material selected. Tag material selection is best advised to be from polymers in the same family as the elastomer such as those made up using at least some monomers related to or the same as those present in the elastomer chosen for the elastic layer. Elastomers that cost more are selected only when their special properties are considered functionally important for a particular article of the invention designed for specialized use.

More on elastomers is contained in three pages entitled "Elastomers" and four pages entitled "Thermoplastic Elastomers," all printed Jan. 28, 2004 from the web site of the Department of Polymer Science, University of Southern Mississippi—all incorporated herein by reference.

A common practice in handling polymeric materials, whether elastomeric or otherwise, is to add compatible (i.e., readily blendable) ingredients to achieve coloration, opacification, resistance to degradation on exposure to some environments, improved impact properties and adhesion properties, etc., all as well known to those skilled in the polymer chemistry arts.

Usually, the elastomeric layer will be substantially uniform in composition throughout its extent (although an elastomer—or mixture of elastomers—forming the loop portion may be different from an elastomer at the bond zone provided the two elastomers blend into a reliable unity at their interface). On the other hand, the tag portion of the new article of the invention may in fact be a laminate of different layers, including a possible protective coating over a printed layer, especially a printed layer that is believed to need further protection against smudging or destruction.

Generally, the bond zone is formed by overlapping edges of the tag and the elastomeric layer. The overlap can be rather extensive if desired (even up to or approaching an inch) but generally need not be greater than about ½ inch or possibly ⅜ inch. Most (but not all) articles are expected to have tags no greater than about 4 or 5 or 6 square inches in size and elastomeric layers that extend out as the elastomeric fastening loop a distance from the bond zone about 1 inch up to about 4 inches or possibly 5 inches, and the overlap for the bond zone for such tags generally need not exceed ½ inch, or even not exceed ¼ inch. Overlaps as narrow as ⅛ inch may sometimes be successfully used, but such narrow overlaps at the bond zone may create trouble. Sometimes people may pull on the tag 12 as they work to place the loop 20 about merchandise, and once the new article is on merchandise, those concerned about checkout scanning may well modestly pull on the tag for that scanning operation. Sometimes customers will mildly pull on the tag in an effort to learn more about the nature of the new article or the merchandise carrying it. These possibilities suggest against using overlaps that are significantly less than about ¼ inch.

The type of unification between the tag material and the elastic layer can affect the size of the overlap needed for the bond zone and will normally be selected by taking into consideration the particular material or materials of the tag and the particular composition of the elastomeric layer to be conjoined at the bond zone. Heat welding as by applying heat and pressure on overlapping thermoplastic polymeric materials forming the tag and the elastic layer can be useful. Significant heat at the interface of overlapping thermoplastic polymeric materials can also result in complete fusion between the polymer of the tag and the polymer of the elastic layer. Sonic welding is another way to unify the layers and achieve a cohesive bond between compatible parts. Laminating a molten elastomer to a molten (or at least softened) tag composition by co-extrusion is another way of forming the bond zone. This method can be particularly effective where molecules or parts of molecules of the tag polymer and the molten elastomer at the bond zone interdiffuse with each other and get tangled up before being frozen (i.e., before being cooled to a non-flowable state). Bonds can also be formed by interposing an intermediate layer at the bond zone (e.g., a hot melt bonding adhesive) to which both the tag material and the elastomeric layer material will readily bond because of their compatibility to the intermediate material. Still further, special treatment of the surface areas where bonding is to be accomplished can be effective. Even mechanical bonding can be effective, as where the tag material is porous (e.g., paper and the porous polymer product called "Teslin"), and the elastomeric layer is applied in molten condition or at least in a softened condition and pressed into the voids or interstices of the porous tag layer.

In short, the invention contemplates any useful bonding technique and structure that will conjoin the labeling tag with the elastomeric layer in a manner forming a unifying flat bond zone that can withstand (without separation) the pulling force (as expected in use) between a tag and elastic layer. The pulling force normally expected in use may be as little as 1 pound, and the bond should be able to withstand at least such a pulling force for 10 seconds. Bonds capable of withstanding pulling forces of at least 2 pounds for 10 seconds, or even at least 3 or 4 or 5 pounds of pulling force for 10 seconds without rupture (breaking apart) of the bond zone, are preferred. In use, it is not the pulling force per unit area or per cross-sectional area that counts. It is the overall resistance of the entire bond zone to separation. Thus, these low pulling forces are per article of the invention, not per linear unit or any area unit. Such is a relatively low requirement for bond strength. Most likely, the greatest pulling force (tag gripped at one end and elastic loop at the other for pulling in opposite directions) is apt to be momentarily encountered (for no more than 10 seconds and usually much less) and probably only encountered during affixing of the tag about merchandise.

A useful bonding consideration is polymer bonding at the bond zone. It essentially amounts to an adjustment of the materials (e.g., tag and elastomer materials) and adjusting the exact interface characteristics of the materials. Generally, similar materials tend to bond together (as by polymer bonding) better than dissimilar materials; and materials of like polarity usually bond better than materials of unlike polarity. Surface treatments such as corona treatments also help to improve bonding. Still further, compatibilizers that adjust the polarity of material can be used to improve bonding.

A notable product of the invention has a high-impact polystyrene tag and an elastic portion formed using a styrene-butadiene-styrene (SBS) block co-polymer available from GLS Corporation under the tradename "Kraton D-2104." This co-polymer has several beneficial features such as high clarity, good dimensional stability, food contact acceptability, relatively high strength, low viscosity, ease of coloring, and high elongation. To improve its adhesion to a styrenic tag substrate, an optional addition of up to 10 percent by weight of polystyrene (based on the weight of the elastomer in the composition) may be blended in the elastomer composition. The composition can easily be colored, as for example by using polystyrene base color concentrates from Clamant (located at 9101 International Parkway, Minneapolis, Minn. 55428) or by using polyethylene base color concentrates from Ampacet (located at 660 White Plains Road, Tarrytown, N.Y. 10591) at concentrations of up to about 5 percent (or even more but more is unnecessary) of the weight of the base styrene-butadiene-styrene block copolymer.

Those skilled in the art will recognize that any suitable process for the manufacture of the new labeling articles of the invention can be employed. Batch processing is useful for extremely limited production runs. Conveyor processing with indexing from station to station for specific operations in putting each discrete product together can be useful (especially for uniquely designed or shaped tags or elastic layers).

Web-based processing may be the most ideal from the standpoint of economy. For example, after giving a high impact polystyrene web (preferably about 8 mils thick and stained for color and any degree of opacity) a surface treatment such as the well-known corona surface treatment, the web is repetitively printed with informational matter as intended for each tag to be later cut from it. The printed (styrenic) tag material web is fed simultaneously with molten elastomer (e.g., a thermoplastic elastomer such as styrenic block copolymer) through the nip of chill rollers. The molten elastomer is applied to extend with a sufficient overlap onto the lateral edges of the web to create the bond zone as well as to extend sufficiently laterally outward from the bond zone (i.e, lateral edge of web) to provide material for the elastic loop. The temperatures of the chill rollers (from about 200 degrees Fahrenheit to about 40 degrees F.) is adjusted to cool the molten elastomer to a "frozen" state while simultaneously applying pressure by the rollers (up to about 500 psi) to effect the formation of a layer of elastomer at the thickness desired and also to effect formation of the bond zone. The outermost edge of the elastomeric layer is longitudinally cut off to create an even edge, following which the lateral and longitudinal positioning of the composite web (of tag and elastomer) is controlled as it is passed in proper registration between die cutting and anvil rollers to cut and score individual tag profiles that are then severed into individual tags of the invention.

The structure of the new labeling article of the invention is believed to be totally strange from anything that has been contemplated in the past. The new article is flexible and sheet-like in character throughout its entire extent, but the labeling tag part of the new structure is of a composition different from the elastic part of the new article. Different properties for different parts of the article, while maintaining a sheet-like character for the entire article (albeit of optionally different thicknesses in different parts) has given results that are looked upon as somewhat astonishing in view of merchandise labels that have been known and available in the past. There appears to have been nothing heretofore to suggest the unique arrangement of elements to get the special performance characteristics exhibited by the new product.

Figure 9:
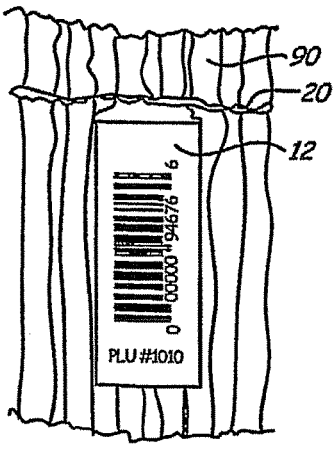
FIG. 9 is a schematic representation of merchandise banded with the new article of the invention.

Speedy application of the new article to merchandise in a single tagging step can be accomplished in a variety of ways. For factory operations, the new labeling articles may be stacked or sequenced by conveyor to a mechanical applicator. Hand application at a variety of off-factory sites can be easily accomplished. A person can align the loops of the tag on some carrier so as to make each labeling article quickly and conveniently accessible for hand application. Some may align a multitude of articles on their arms; others may align on some sort of movable carrier. Some may just place the new labeling article in a bag and grab from the bag in affixing the labeling article on merchandise. Many are apt to use the fingers of both hands to stretch the elastomeric loop in placing it about merchandise, but others may exert some pull on the tag portion as they place the loop about merchandise. Nevertheless, the bond zone is not likely to ever receive the extremes of strain and stress that the elastic fastening loop itself is likely to receive. FIG. 9 illustrates use of the new article on a clump of merchandise 90, with the fastening loop 20 surrounding the merchandise and the tag 12 dangling from the loop.

The new article (when made resistant to water damage) is very useful for field application of it to agricultural product even before the produce is washed. But it obviously can conveniently be applied to washed agricultural produce. Further, the new labeling article has a multitude of other uses because of its unique properties and ease of attachment (i.e., fastening on merchandise). Elongated manufactured products can easily be clumped using the new article. Slender necked bottles (as for soft drinks, beer, ketchup, syrup, etc.) can readily carry the new labeling article—and circular loops are especially advantageous for this use. Floral arrangements can easily be labeled using the new labeling article. After being looped about merchandise, the pulling forces against the bond zone 14 are mighty low, and indeed may even be insignificant, inasmuch as dispersion and even dissipation of loop in-line stretching tension takes place with the result that the bonding zone is subjected to little stress even though the elastic loop is in stretched condition about merchandise.

Figure 10:
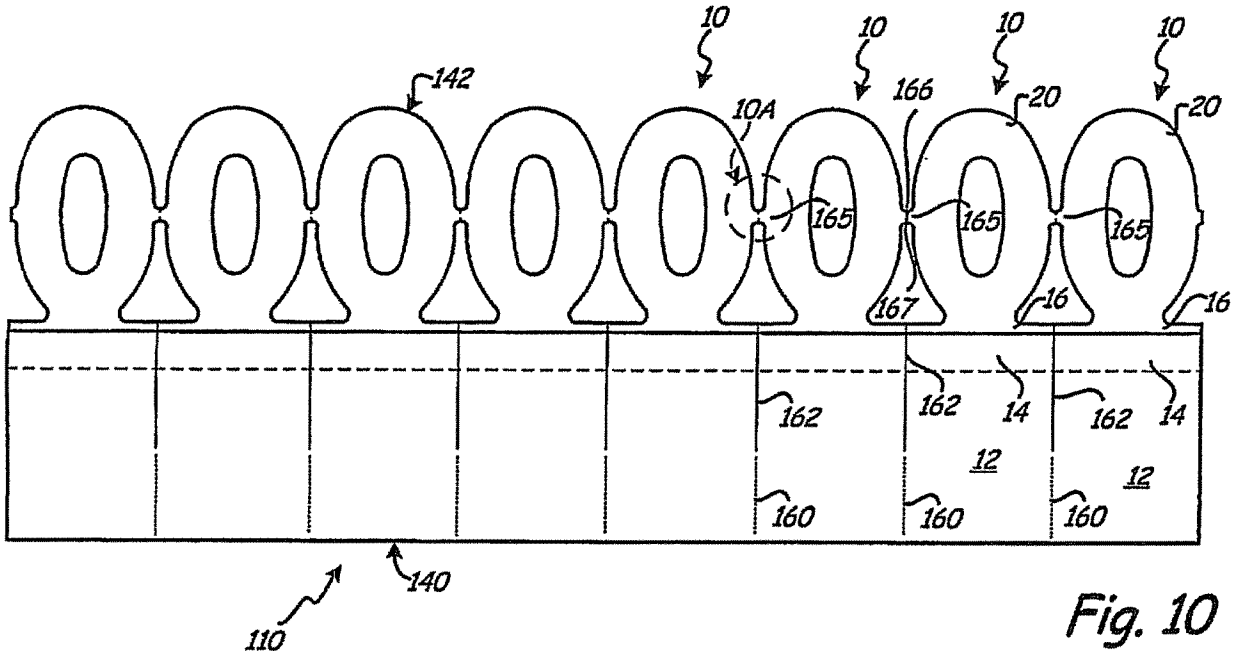
FIG. 10 is a schematic front view of a linear series of connected unitary sheet-like labeling articles of the present invention.
Figure 11:
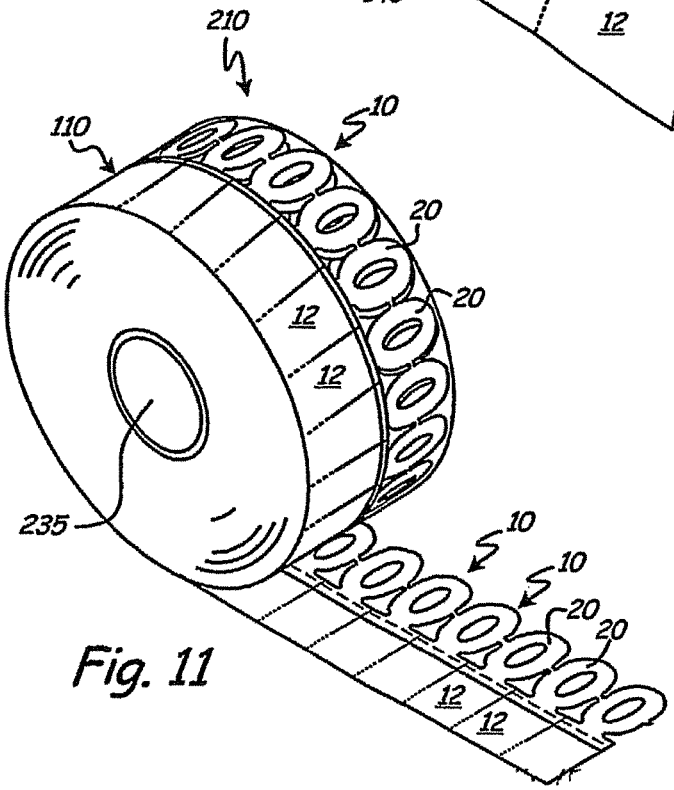
FIG. 11 is a perspective schematic representation of a roll formed from a linear series of connected unitary sheet-like merchandise labeling articles of the present invention.

The new merchandise labeling articles of the invention can be marketed in a variety of forms. For example, labeling articles 10 may be marketed individually (such as seen, for example, in FIGS. 1-9), or in a unique linear strip or linear series 110 (such as seen, for example, in FIG. 10), or in a unique roll 210 of such a linear series 110 (such as seen, for example, in FIG. 11). When in the form of a linear series 110, the labeling articles are essentially in sheet or web form. When in the form of a roll 210, the linear series 110 is typically wound about a cylindrical and rigid core 235, as seen in FIG. 11. A first side edge 140 of the linear series 110 is defined by a strip of adjacent tags or tag portions 12 of the articles 10 while a second, opposed side edge 142 of the linear series 110 is defined by a strip of adjacent fastening loops 20 of the articles 10.

Longitudinally adjacent labeling articles 10 in a linear series 110 are ruptureably connected so that (whether in strip or roll form) each individual merchandise labeling article can be ruptureably separated from the remainder of the labeling articles of the linear series 110. Each individual merchandise labeling article from such a linear series can thus be separated from the series and separately placed on or about merchandise (e.g., produce, cut flowers, or product packaging such as a bottle, can or jar).

In all instances of product variation, the fundamental characteristics of the unitary sheet-like merchandise labeling articles of the invention as afore-described are always present. The ruptureable connections adequately hold the individual merchandise labeling articles together for handling purposes but allow easy and convenient rupture so as to separate an outermost individual labeling article 10*a* from a next individual labeling article 10*b* on an end of the linear series 110, such as seen, e.g., in FIG. 12. Keeping in mind the generally greater thickness of the elastic layer of the labeling article as well as the flimsy nature of the elastic layer of the article as compared to the relatively stiffer but yet flexible tag portion of the article, the nature of a linear series of ruptureably connected merchandise labeling articles is quite different than that believed to exist heretofore.

Figure 13:
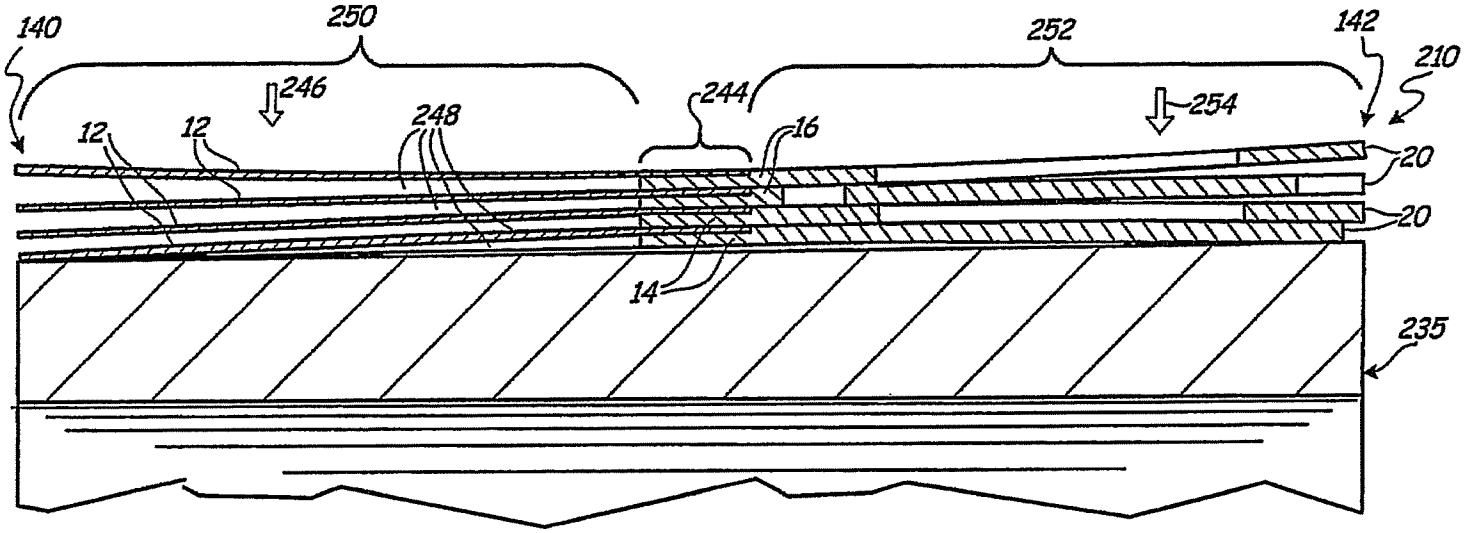
FIG. 13 is a sectional view of a roll of a linear series of the present invention, with only four layers of linear series windings upon a core for the roll (for illustrative purposes).

The ruptureably connected strip of tag portions 12 define a longitudinally extending web of sheet-like material which can be handled in a relatively typical manner, but the ruptureably connected strip of elastic fastening loops 20 is relatively floppy and maintains its longitudinal relationship between adjacent fastening loops 20 in large part because each loop 20 is bonded to an associated tag portion 12, but also because adjacent loops 20 are connected. These disparate material handling characteristics are quite notable when the inventive linear series is wound in roll form. Specifically, depending on the exact nature of manufacture but taking into account the nature of the labeling articles of the invention, the only portion of a roll 210 of such a linear series 110 wound in a tight condition about the core 235 is that portion identified as the portion of the merchandise labeling article where the unifying flat bond zone 14 between the tag 12 and the flexible elastic layer 16 is present, as particularly illustrated diagrammatically in FIG. 13 by tightly rolled segment 244 of roll 210. Other segments of the roll 210 appear to be rather loosely wound, as described below.

The tag portion 12 of each article projects laterally out from its respective unifying flat bond zone 14 and wraps of the tag portions 12 forming a segment 250 of the roll 210 are in overlapping condition. The first side edge 140 of the linear series 110 forming the roll 210 is formed of tag portions 12 and thus presents a roll exterior that can be partially collapsed or pinched radially (e.g., in the direction of arrow 246 in FIG. 13), but also that generally takes an irregular form as a portion of the roll 210 in that varying space conditions exist between the different wraps or layers of tag material 12 making up the segment 250 of the roll 210. Such varying space conditions are illustrated as radially disposed spaces 248 in FIG. 13.

Figure 14:
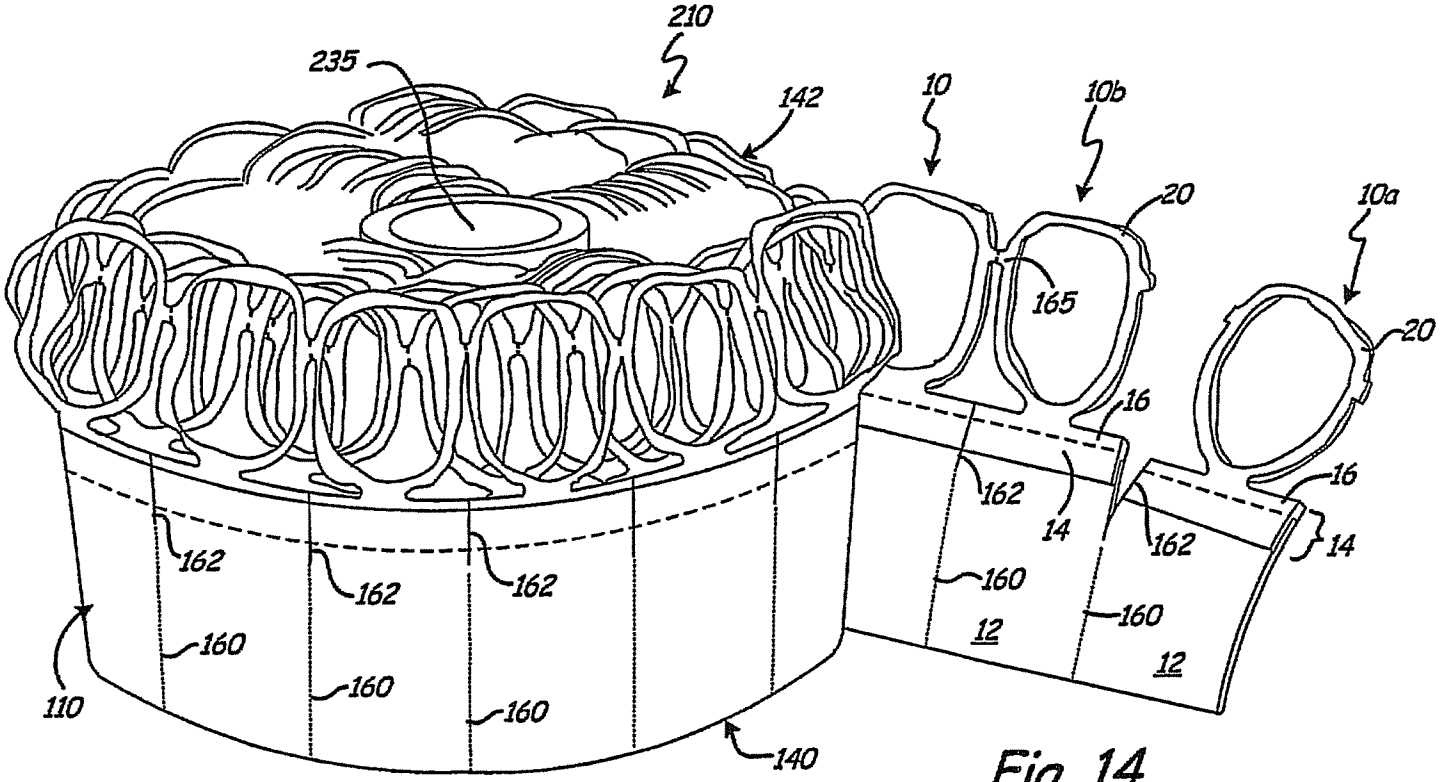
FIG. 14 is a perspective view of a roll of a linear series of connected unitary sheet-like labeling articles of the present invention, illustrating an alternative form of flexible loops for the labeling articles of the linear series.

On the other side of each bond zone 14, a fastening loop 20 projects laterally outwardly, and wraps of the fastening loops 20 forming a segment 252 of the roll 210 are in overlapping condition. The second side edge 142 of the roll 210 is formed of fastening loops 20 and presents a quite different form of roll edge, however, than the first side edge 140, such as illustrated in FIG. 14. Varying space conditions also exist between the different wraps or layers of fastening loops 20 making up the roll 210, not only because adjacent loops 20 may be spaced apart, but also because of the cutouts within the elastic layer forming the loops themselves. The elastic nature of the fastening loops 20, even though wrapped and bonded to the wrapped tag portions 12, may appear to define a relatively unorganized layering of that laterally projecting elastic portion (roll segment 252). The elasticity of the wrapped layers of fastening loops 20 allows the second side edge 142 of the roll 210 (formed of fastening loops) to be partially collapsed radially under pressure (e.g., in direction of arrow 254 in FIG. 13), and to be deformable axially. The noted characteristics of such a roll 20 give that roll 210 an unusual appearance when one compares what one usually obtains by wrapping generally sheet-like material in roll form. The roll has the appearance of a rather loosely wound strip of two-part material, although it is generally tightly wound adjacent the bond zone between the tag portions and the fastening loops (i.e., tightly wound at roll segment 244 in FIG. 13).

FIG. 14 illustrates the form of the roll 210, generally like that seen in FIG. 11. In the case of the roll in FIG. 14, an alternative shape for the fastening loop is illustrated, wherein a greater extent of the elastic material has been removed than in the form of the fastening loop shown on the roll in FIG. 11. The rolls of FIG. 11 and FIG. 14 are merely illustrative of the kinds of roll configuration possible with the present invention. As noted above, different shapes of tags 12 may be employed (longer, wider, not parallelograms, etc.), and different forms of fastening loops can be employed as well (see, e.g., FIGS. 1-9). The nature of the segment 252 (see FIG. 13) of the roll 210 formed of the fastening loops may vary depending upon the shape of the fastening loops of the roll. For example, the more elastic material that is removed to define a fastening loop, the more floppy and loose an appearance will be presented for the fastening loop segment 252 of the roll 210. In addition, while the rolls in FIGS. 11 and 14 are each illustrated with a central core 235, the formation and use of a coreless roll of a linear series of labeling articles is also contemplated.

The inventive linear series of connected unitary sheet-like merchandise labeling articles are connected so that adjacent labeling articles of the series are ruptureably connected together in a manner permitting the series to be handled as a unit, while at the same time permitting quick and simple ruptureable separation of individual merchandise labeling articles from the series. As noted above, adjacent labeling articles of the series are oriented so that one opposing edge of the series is formed by the labeling tags of the labeling articles and the other opposing edge of the series is formed by the elastic fastening loops of the labeling articles. In one embodiment, the ruptureable connection between the adjacent labeling articles of the series includes a ruptureable connection between the adjacent labeling tags thereof as well as a separate ruptureable connection between the adjacent elastic fastening loops thereof.

Figure 12:
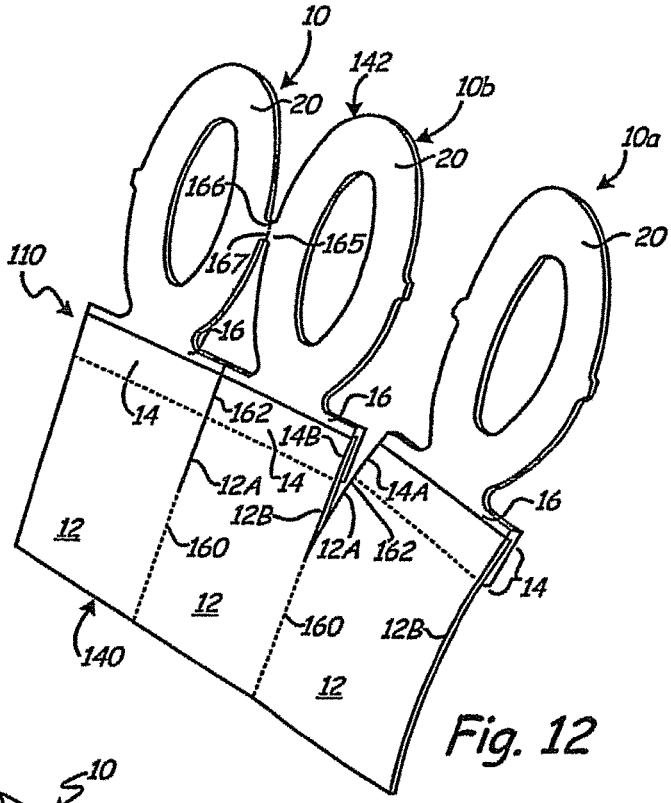
FIG. 12 is an enlarged perspective view of a linear series of the present invention, illustrating partial separation of an end-most labeling article, with a connecting link between its flexible loop and a next adjacent flexible loop having been ruptured, and illustrating ongoing partial rupturing of a line of weakness between adjacent labeling tags 10*a* and 10*b*.

As seen in FIG. 12, the ruptureable connection between adjacent labeling tags 12 may comprise a connecting line of weakness 160 joining lateral edges of the adjacent labeling tags 12 (such as adjoining sides 12A and 12B). The connecting line of weakness 160 may comprise a line of perforations, or the line of weakness may comprise a scoring line in addition to or separate from a line of perforations. In one embodiment, the line of weakness 160, whether defined by perforation or scoring, generally will not extend through the lateral edges of the bond zone 14 of adjacent labeling tags 12. In other words, adjacent lateral edges of the bond zone 14 (such as edges 14A of tag 10*a* and 14B of tag 10*b* in FIG. 12, including both the tag material layer and the elastic material layer in the bond zone 14) are generally cut and thus are separable without tearing along a line of scoring or perforation. The severing apart of portions of the tags 12 while still in the form of a linear series is illustrated by cut 162 between adjacent tags 12, which may include portions of the tags both within and not within the bond zone 14. In one embodiment, the cut 162 and line of weakness 160 between adjacent tags 12 are colinear.

Figure 10A:
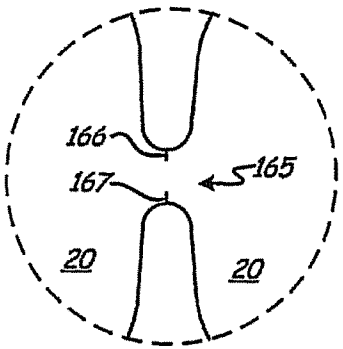
FIG. 10A is an enlarged view of area 10A in FIG. 10.

The ruptureable connection between adjacent elastic layers 16 comprises a connecting link 165 of elastic material having a lateral extent no greater than approximately 3/16 inch in the plane of the elastic layer 16. As best seen in FIG. 10A, opposed longitudinal sides of each link 165 have lateral cuts 166 and 167 therein to facilitate separation of adjacent fastening loops 20. The cuts 166 and 167 are typically colinear, and in one embodiment, the cuts 166 and 167 are colinear with the cut 162 and line of weakness 160 between adjacent labeling articles in the linear series. In one embodiment, the extent of the connecting link 165 in the plane of the elastic layer is between approximately 15 and 80 mils, with an extent of about 60 mils being preferred in some instances. In one embodiment, the ruptureable connection between elastic layers is a single connecting link 165, but it is contemplated that the ruptureable connection between adjacent elastic layers may comprise multiple links as well, so long as the function of ready and simple separation of the adjacent elastic layers (and fastening loops thereon) is achieved. In addition, when a labeling article such as that illustrated in FIG. 8 is made in a linear series form, the connecting link simply constitutes one or more small uncut segments of the elastic layer between contiguous sides of adjacent fastening loops 20 (e.g., an uncut segment of 15-80 mil in length).

Alternative forms or materials used in forming the desired labeling articles may also affect the form of ruptureable connections between adjacent labeling articles in a linear series. While in the illustrated embodiments of the present invention, ruptureable connections are shown between both adjacent tag portions 12 and fastening loops 20, it is contemplated that multiple connections may be provided only on the tag portions of a linear series or only on the fastening loop of a linear series. In addition, in some embodiments, it may be desirable to provide one or more ruptureable connections adjacent the bond zone. For example, one form of ruptureable connection between adjacent labeling tags 12 may comprise a complete severing of the tag material layer in the bond zone 14, but an incomplete severing of the elastic material layer in the bond zone 14. In this instance, a small (e.g., 15-80 mil) connecting link of the elastic material layer is left uncut between the contiguous sides of the bond zones 14 of adjacent labeling tags 12, thus serving to connect those tags until separation is desired. In another embodiment, a connecting link between the elastic layers of adjacent labeling articles may be disposed between lateral shoulders 18 thereof (see, e.g., shoulders 18 in FIGS. 1, 3, 4, 6 and 7), disposed "above" the bond zone 14.

An efficient arrangement for storing, handling and dispensing of labeling articles is a roll of a linear series of selectively separable unitary sheet-like merchandise labeling articles. Whether in strip or roll form, however, the shape (i.e., height, width, curvature, hole shape, etc.) of the elastic fastening loops 20 in the plane of the elastic layer 16 can vary considerably, as for example illustrated when comparing the labeling articles of FIGS. 1-5 and 12 and 14. Similarly, as noted above, other features and relationships of the labeling articles (and thus their associated linear series) can vary considerably.

A significantly notable feature of the new separable labeling article (whether in the form of a roll or a linear series) is that dealing with the nature of the unitary flat bond zone. As noted above, that bond zone may be formed by an overlapping bonding of portions of the tag 12 and elastic layer 16. In this regard, the thickness of the elastic layer 16 is greater than the thickness of the tag 12 in the labeling article 10 as it is usually made. The effect of this is to create a rather striking bond zone 14 or unifying flat bond zone 14, as seen in profile in FIGS. 2, 12, 13 and 14. A roll of the inventive linear series 110 may be made without actual literal overlap of the unifying flat bond zone 14 in successive wraps of the roll. However, the most efficient roll of the linear series appears to be a roll where the unifying flat bond zone is literally wrapped in overlapping layers to form the roll, as illustrated by roll segment 244 in FIG. 13. This creates a distinctively different appearance feature for the opposed edges of the roll, with one edge dealing with the tag while the other edge deals with the elastic layer. First of all, the wrapping of the unifying flat bond zone in overlapping layers upon itself places that zone in contiguous contact throughout the radial extent of the roll, and allows for that segment of the roll to be tightly wound. What happens, however, is that the labeling tags of the roll then become somewhat loosely oriented around the roll because some parts of each labeling tag will press against one or more internal labeling tags (of the next smaller wrap) whereas other parts of the same labeling tag will press against one or more external labeling tags (of the next larger wrap). This creates a rather uneven rolled article appearance that could, to a casual observer, suggest less-than perfect winding. However, it is impossible to make a continuous contact winding of all parts of each labeling tag in the roll when the thickness of the labeling tags is so thin as compared to the portion of the roll where literal tight overlapping is possible (i.e., the unifying flat bond zone). This phenomenon is aptly illustrated by a comparison of roll segments 244 and 250 in FIG. 13, and by the occasional spacings 248 which exist between the tags 12 of subsequent wrapped layers of the linear series forming the roll 210.

To the casual observer, the rolled layers of elastic layer (fastening loops) may appear somewhat disorganized and almost unpredictable due to the floppy nature of the elastic layer of the roll, even though the elastic layer is generally essentially equal in thickness to the thickness of the joined elastic layer and tag at the unifying bond zone. The elastic layer is relatively much more flimsy than the tag (and the bond zone including a portion of the tag) and does not necessarily retain a specific body shape. The wrapped layers of fastening loops (roll segment 252 in FIG. 13) are easily crushed and modified simply by modest handling. An attempt to illustrate this feature and the generally flimsy nature of the flexible loop segment of the roll is set forth in FIG. 14.

The process for making the individual articles (i.e., the basic unitary sheet-like merchandise labeling articles of the invention) is set forth above. The process for making a linear series of selectively separable labeling articles is similar, but individual labeling articles are not die cut apart as individual tag profiles as part of the process. After the process afore-described has been completed with molten elastomer fed through a roller nip and overlapped relative to an outer edge of the tag material web to create a bond zone, as well as to extend sufficiently laterally outward from the bond zone to provide material for the elastic loops, the outermost edge of the elastomeric layer is generally cut off to create an even edge of the composite web. In one embodiment, a single linear series of labeling articles is formed by the composite web. The composite web is then further processed as described below to define a linear series of labeling articles.

In another embodiment, two linear series of labeling articles are simultaneously formed by the composite web. In this latter embodiment, molten elastomer is fed through a roller nip and overlapped relative to both lateral sides of a web of tag material to create parallel and laterally spaced apart bond zones on the composite web. Again, sufficient elastic layer material extends laterally outwardly from each bond zone to provide material for the elastic loops, and the outermost edges of the elastomeric layers are generally cut off to create even longitudinally-extending side edges of the composite web.

The composite web, with each side edge thereof formed from a layer of elastic material, is selectively cut using a die (e.g., a rotary die) kept in registration with printed indicia on the tags. During this die cutting process, the fastening loops are cut, and the connecting links between the adjacent fastening loops defined, along with any cuts in edges of the connecting links. In addition, the die makes the cut between adjacent labeling tags, cutting through the tag material web in the bond zone and, if desired, a portion of the tag material web below the bond zone. At the same time, the die also creates the line of weakness between adjacent tags (e.g., by scoring or forming perforations).

Figure 15:
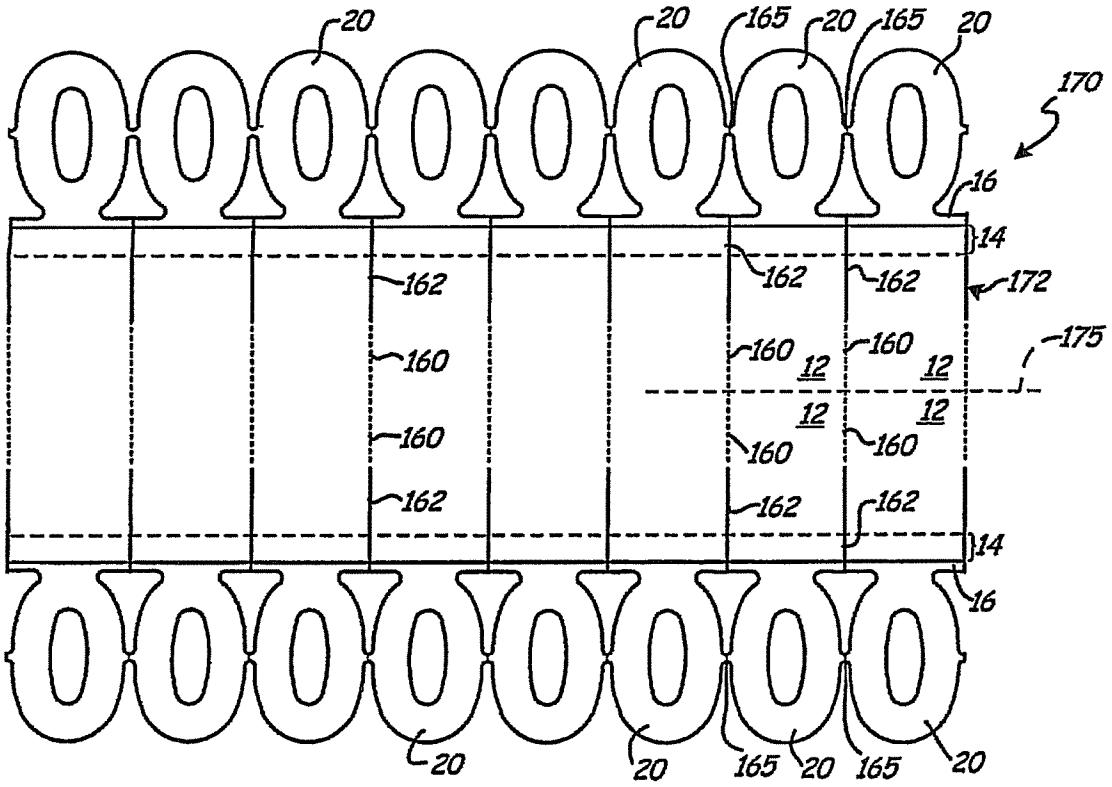
FIG. 15 is a schematic frontal view of an in-process composite web after die cutting thereof to form two side-by-side linear series of the present invention simultaneously.

FIG. 15 illustrates an in-process linear series product showing a composite web 170 after it has passed such a die. For instance, fastening loops 20 have been formed on the elastic layer 16 on each side of the composite web 170, with adjacent fastening loops 20 connected by a connecting link 165. Each fastening loop 20 is connected by its respective bond zone 14 to a portion of a central tag material web 172. On each side, cuts 162 have been formed through the elastic layer 16, bond zone 14 and into the tag material web 172. A line of weakness 160 has been formed in the tag material web 172, extending from an inner end of each cut 162. Pairs of bottom-to-bottom, laterally connected adjacent labeling articles are thus defined in this die cutting step and severed apart from each other, except (in the illustrated embodiment) for the perforation line 160 therebetween and the connecting link 165 between adjacent fastening loops 20. As seen in FIG. 15, two labeling articles are simultaneously formed in a longitudinal machine direction, connected along bottom edges of their preformed tag portions 12. The composite web 170 illustrated in FIG. 15 is then cut using a longitudinally-disposed knife with perforations to separate the pairs of laterally connected labeling articles, along the phantom line 175 in FIG. 15. This latter cutting step essentially splits the composite web 170 in half, except along the uncut perforation elements which retain the composite web 170 together to allow it to be transported to and proceed at a web rolling station.

The perforations which are formed in the tag material web of the composite web along line 175 may be spaced several inches apart, depending upon the width of the tags being formed. The line of perforations (which typically extends longitudinally along the center of the composite web 170) permits the composite web 170 to be wound up on a pair of side-by-side coaxially oriented yet separate cardboard cores of the same diameter that are spaced to line up with the composite web. The cardboard cores are located on a first common shaft which, as is generally known, has a slip clutch to facilitate coordinated shaft rotation with the speed of the advancing composite web and to follow the speed of die cutting, tag material web feeding and composite web formation. Once the two side-by-side rolls of labeling articles are wound to their maximum desired diameter (while still bound together, as wound, along the perforations of perforation line 175), the common web is laterally severed, and a leading end of the remaining (unwound) common web is diverted and taped to two more coaxial, separate cores loaded on a second slip clutch shaft. This allows the die cutting operation to continue without stopping, even though there is a severing of the composite web as subsequent rolls are formed. The two side-by-side finished rolls are removed from the first shaft. Again, the rolls are still bound together along the perforations of perforation line 175, but their cores are separate. Once removed from the shaft, the two rolls can be readily separated manually by bursting the perforation elements therebetween along the line of perforation 175. The operation thus simultaneously results in the formation of a pair of rolls 210 of labeling articles disposed in a linear series 110, such as illustrated in FIG. 11 or 14 (although one roll is wrapped clockwise while the other is wrapped counterclockwise).

In this roll form, individual labeling articles can thus be readily and easily removed, one by one, from the free end of the roll, as seen in FIG. 14. The individual labeling articles 10 in the linear series 110 are already largely separated by the cuts 162 between them. As seen in FIG. 12, pulling the endmost labeling article 10*a* away from the linear series 110 breaks apart any connecting link 165 that might be disposed between adjacent elastic layers 16, and the separation of tags 12 along the cut 162 propagates the tearing apart of adjacent tags 12 along the common line of weakness 160 therebetween until complete separation is achieved. This arrangement has proved particularly useful in the produce field, where produce is gathered and bunched manually for further processing or distribution. A worker gathering or processing produce can simply dispense an individual labeling article from a nearby roll (which may be borne, for example, on a vehicle associated with the worker or carried by the worker himself), and use that individual labeling article to capture the produce (using the flexible loop 20) and thus provide a ready and durable label for that captured produce (see, e.g., FIG. 9). A next individual labeling article is waiting at the end of the roll for a subsequent similar fastening and labeling operation, and so on.

In addition to manual dispensing of discrete labeling articles from such a roll as seen in FIG. 14, automated dispensing is also contemplated. A roll may be supported by suitable equipment for attaching individual labeling articles on discrete materials or containers (such as bottles or drawers) as they are processed through a filling and labeling facility.

While the discussion immediately above relates to the dispensing of labeling articles from a roll of a linear series, it is also contemplated that such dispensing may be done from a linear series in strip form, either stacked like discrete sheets (like seen in FIG. 10) for dispensing and separation manually or by some automated means, or in an endless strip which is fan folded and stacked for such dispensing. In all aspects and embodiments of the present invention, the inventive linear series of ruptureably connected unitary sheet-like merchandise labeling articles (whether in strip or roll form) permits the ready removal of a discrete labeling article from a free end thereof for further manipulation with respect to a product or other desired article or packaging for such an article. The removal of discrete labeling articles from the linear series may be sequentially continued until all labeling articles in the series are used, and each one will satisfactorily serve the labeling and binding or attaching purpose intended.

Further, those skilled in the art will readily recognize that this invention may be embodied in still other specific forms than illustrated without departing from the spirit or essential characteristics of it. The illustrated embodiments are therefore to be considered in all respects illustrative and not restrictive, the scope of the invention being indicated by the appended claims rather than the foregoing description, and all variations that come within the meaning and range of equivalency of the claims are therefore intended to be embraced thereby.

The invention claimed is:

1. A roll of a series of labeling articles, the roll comprising:

a tag strip of ruptureably-connected tag portions of the labeling articles; and a loop strip of elastic fastening loops of the labeling articles secured to the tag strip at a bond zone;

wherein the series of labeling articles are wound in an overlapping tight condition at the bond zone, and wherein the loop strip is wound with varying space conditions between layers of the loop strip.

2. The roll of claim 1, and further comprising a rigid core on which the series of labeling articles are wound.

3. The roll of claim 1, wherein the elastic fastening loops are partially collapsible radially under pressure.

4. The roll of claim 1, wherein the loop strip includes a cutout between adjacent elastic fastening loops.

5. The roll of claim 1, wherein the elastic fastening loops are deformable axially.

6. The roll of claim 1, wherein adjacent tag portions are ruptureably-connected with at least one line of weakness.

7. The roll of claim 1, wherein adjacent elastic fastening loops are connected with at least one link at a location that is offset from the bond zone.

8. The roll of claim 1, wherein the loop strip has a layer thickness that is greater than a layer thickness of the tag strip.

9. The roll of claim 1, wherein a radial dimension of a loop strip portion of the roll is greater than a radial dimension of a tag strip portion of the roll.

10. The roll of claim 1, wherein adjacent elastic fastening loops of the loop strip are at least partially separated by at least one cut at the bond zone.

* * * * *